US006798181B2

(12) United States Patent
Emmerik

(10) Patent No.: US 6,798,181 B2
(45) Date of Patent: Sep. 28, 2004

(54) VOLTAGE SUPPLY CIRCUIT FOR REDUCING POWER LOSS THROUGH A GROUND CONNECTION

(75) Inventor: Arnoldus Johannes Maria Emmerik, Nijmegen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 227 days.

(21) Appl. No.: 10/040,060

(22) Filed: Oct. 29, 2001

(65) Prior Publication Data

US 2002/0113653 A1 Aug. 22, 2002

(30) Foreign Application Priority Data

Oct. 31, 2000 (EP) ..... 00203788

(51) Int. Cl.[7] ..... G05F 3/04
(52) U.S. Cl. ..... 323/312

(58) Field of Search ..... 323/311, 312

(56) References Cited

U.S. PATENT DOCUMENTS

| | | | | |
|---|---|---|---|---|
| 4,686,449 A | | 8/1987 | Jeffrey et al. | 323/231 |
| 4,760,284 A | | 7/1988 | Taylor | 307/296 |
| 5,220,530 A | * | 6/1993 | Itoh | 365/189.01 |
| 5,285,369 A | | 2/1994 | Balakrishnan | 363/49 |
| 5,359,256 A | | 10/1994 | Gray | 313/169 |

* cited by examiner

*Primary Examiner*—Adolf Berhane
(74) *Attorney, Agent, or Firm*—Michael J. Ure

(57) ABSTRACT

A circuit includes a first transistor connected in series to a second transistor. A gate of the first transistor is connected to a source of the second transistor. The gate of the first transistor may also be connected to a load and may not be connected to ground. A gate of the second transistor may be connected to ground. The transistors are preferably formed by silicon on insulator integration technology.

2 Claims, 2 Drawing Sheets

VOLTAGE SUPPLY CIRCUIT FOR REDUCING POWER LOSS THROUGH A GROUND CONNECTION

The present invention relates to a circuit arrangement of transistors, particularly of JFETs, for use in supply circuits, particularly for high voltage integrated circuits (ICs).

According to the prior art such a circuit comprises a transistor connected between a high voltage supply and a load, e.g. a capacitor, and has its gate connected to ground to dissipate the multiplication current to ground. This leads to dissipation without any use.

It is an object of the invention to provide a supply circuit with a reduced dissipation and/or (multiplication) current loss. To this end, the invention provides a supply circuit as defined in the independent claims. Advantageous embodiments are defined in the dependent claims.

According to one aspect of the invention, there is provided a circuit comprising a first transistor, preferably a JFET, connected in series to a second transistor, also preferably a JFET, wherein the gate of the first transistor is connected to the source of the second transistor and is not connected to ground. The gate of the second transistor is preferably connected to ground.

Preferably the transistors are JFET transistors and at least the first JFET transistor is advantageously formed by a silicon on insulator (SOI) integration technology, for example as described in applicant's non-prepublished European application 99 204 404.0.

According to a preferred embodiment the first transistor is a high voltage JFET and the second transistor is a low voltage JFET. This circuit configuration is particularly advantageous when used to regulate the voltage to charge a capacitor and is applicable to lighting IC and power supply applications. The circuit is substantially multiplication independent.

The unique circuit configuration reduces the power loss through the ground connection of the gate of the second transistor because multiplication current from the gate of the first transistor bypasses the second transistor and is fed directly into the current path of the source of the second transistor.

For a better understanding of the present invention and to show how it may be carried into effect, reference will now be made, by way of example, to the accompanying drawings.

Figure 1:
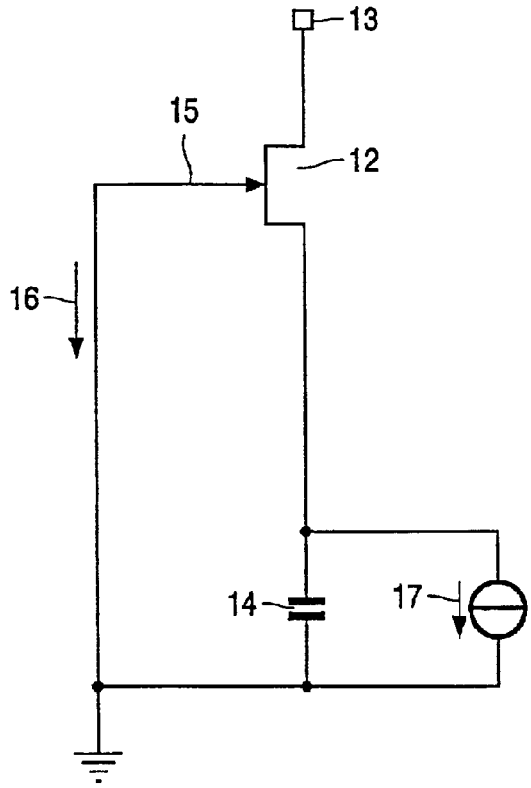
FIG. 1 is a circuit diagram of a prior art circuit.

FIG. 1 shows a circuit for a junction isolated process with a JFET 12 connected between a high voltage supply 13 and a load comprising a capacitor 14 and current source 17. The gate 15 of the JFET 12 is connected to ground so as to sink the multiplication current 16 Imult of the JFET 12 to ground to reduce its contribution to the regulated voltage node.

Typically the high voltage supply 13 would supply 650 V and assuming a typical multiplication factor M=2 for the circuit of FIG. 1 then the multiplication current 16 Imult to ground will be 250 $\mu$A, and will be the same as the load current 17 load across the capacitor 14, for a typical regulated voltage of 40 V. Although the multiplication current 16 Imult does not contribute to the regulated voltage node, it does contribute to the power dissipation. In this example the total power dissipation is 0.33 W of which 0.16 W is due to the multiplication current 16 Imult being led to ground.

Figure 2:
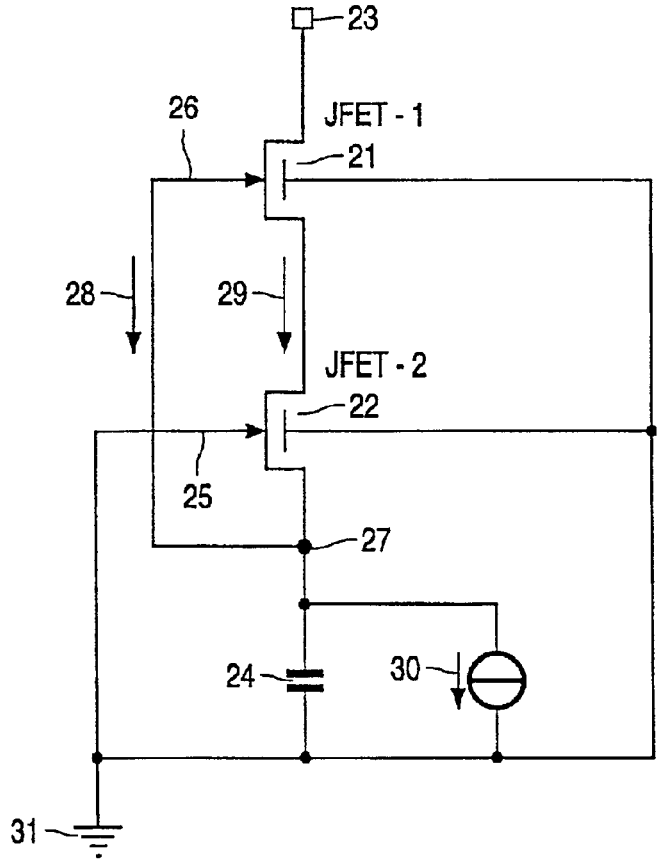
FIG. 2 is a circuit diagram of a circuit according to the present invention.

In FIG. 2 the circuit of the invention comprises two JFETs 21 and 22 connected in series between a high voltage power supply 23 and a load comprising a capacitor 24 and a current source 30. The capacitor 24 serves to flatten fluctuations at the load 30. While in this drawing, the load is represented by a current source 30, it may be any load that needs a regulated voltage. The circuit of FIG. 2 could be used as a start-up circuit in a high-voltage IC such as used in a switched mode power supply for televisions, in which case the load would be formed by other circuits in the high-voltage IC. It could be used in a lighting IC to switch on lighting equipment.

The gate 25 of the JFET 22 is connected to ground but the gate 26 of JFET 21 is connected to the source of JFET 22 at node 27 and is not connected to ground. The JFET 21, and advantageously also JFET 22, is preferably formed by a silicon-on-insulator process as described in EP 99 204 404.0.

In the example illustrated with a power supply 23 of maximally 650 V (but normally, absent from any power fluctuations, being around 240 √2 V), the multiplication current 28 Imult1 at the gate of JFET 21 is 125 $\mu$A and the load 29 current Iload1 through the JFET 21 is 125 $\mu$A. For a regulated voltage Vpinch typically of 40 V at the node 27, the load current 30 Iload2 across the capacitor 24 needs to be 250 $\mu$A and this comprises the sum of Iload1 (29) and Imult1 (28). No multiplication current from JFET 21 is thus lost. The multiplication current Imult2 from JFET 22 is small or non-existent because the drain voltage on JFET 22 is small. Thus in this example the power dissipation is reduced by 50%, compared to the circuit of FIG. 1, to 0.16 W.

Figure 3:
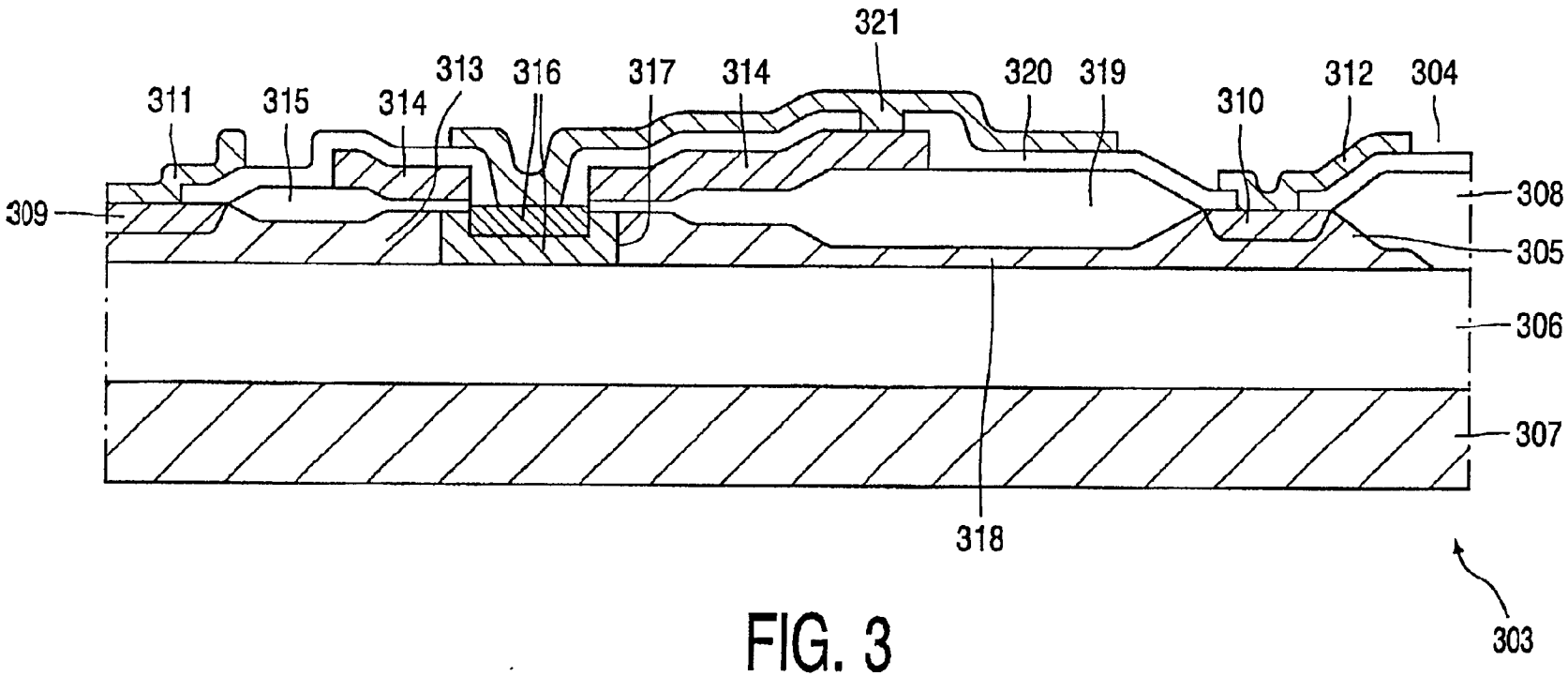
FIG. 3 is a cross-section through a JFET made by a silicon-on-insulator process that is suitable for use in the circuit of FIG. 2.

FIG. 3 illustrates a typical silicon-on-insulator JFET transistor as described in EP 99 204 404.0. The circuit comprises a semiconductor body 303, in this example made of silicon, with a semiconductor layer 305 of a first conductivity type, of n-type silicon in this example of an n-channel transistor, adjoining the surface 304. The thickness and the doping concentration of the layer 305 are, for example, 1 to 1.5 $\mu$m and $10^{16}$ to $5\times10^{16}$ atoms per $cm^3$. The silicon layer 305 is bounded at the side opposed to the surface 304 by a layer 306 of electrically insulating material which insulates the silicon layer 305 from the subjacent silicon substrate 307. The substrate 307 is preferably n-type doped. The layers 305 and 306 form a SOI (Silicon On Insulator) structure which may be manufactured in various ways which are known per se. Thus the layer 306 may be formed, for example, by a layer of aluminum oxide (sapphire) on which the silicon layer 305 is epitaxially grown. Other techniques which may advantageously be used are "smart cut" and "wafer bonding" techniques, whereby two crystals, of which at least one is provided with an oxide layer, are fastened to one another, whereupon the silicon layer 305 can be manufactured from one of the crystals through etching or polishing. In the present example, the insulating layer 306 is formed by a buried layer of silicon oxide which is obtained in a known manner by a smart cut technique. The thickness of the layer 306 is approximately 3 μm.

Islands which are mutually electrically insulated, for example by means of regions 308 of silicon oxide extending transversely across the thickness of the silicon layer 305, are formed in the layer 305. The transistor comprises a source in the form of a strongly doped n-type surface zone 309 and a drain in the form of a strongly doped surface zone 310. The source and the drain are connected to a metal contact 311 and a metal contact 312, respectively. The drain lies around the source in this embodiment, but it will be obvious that alternative configurations are equally possible. A channel region 313 formed by a portion of the island-shaped n-type silicon layer 305 is situated between the source 309 and the drain 310. A gate 314 in the form of an n-type doped polycrystalline silicon layer, referred to as poly for short hereinafter, is provided above the channel region. The channel and the gate are separated from one another by a layer 315 of silicon oxide which forms the gate dielectric of the transistor. The thickness of the oxide layer 315 is approximately 0.8 μm in the present example of a high-voltage transistor. Some other suitable material may be chosen instead of silicon oxide for the gate dielectric.

The transistor forms a depletion MOS transistor in which a depletion region is induced in the channel by a negative voltage (with respect to the source) at the gate 314, which controls the conduction between source and drain. When the depletion region pinches the channel at a sufficiently high voltage at the drain, the transistor is in the pinch state. To prevent inversion occurring at the boundary between the channel 313 and the gate oxide 315 and at the boundary between the channel 313 and the buried oxide layer 306 in this state, the n-type silicon layer 305 is provided with at least one p-type zone 316 (having a higher doted contact zone) which forms a pn junction 317 with the channel and which extends transversely across the thickness of the channel 313. To obtain an efficient charge removal for any width of the channel, adapted to the specific application, a number of zones 316 distributed over the channel width are provided in the semiconductor layer. Most of these zones are rectangular in shape; the zones 316 at either end of the transistor have a curved shape and cover the entire bend in the channel. This, however, is not necessarily the case; it is alternatively possible for small zones 316 to be formed at the ends, mutually separated by portions of the channel. The shape of the zones 316 at either end as shown here has certain advantages for design technology which arise from the chosen oval shape of the transistor. In an embodiment in which the transistor is not oval but, for example, rectangular, it is obvious that mutually separated zones 316 may be used at the ends. To prevent the pinch voltage being determined by depletion caused by the zones 316 (as in a junction field effect transistor), the zones should be situated at sufficiently great distances from one another, as compared with the channel thickness. On the other hand, the zones 316 are preferably situated so closely together, for an efficient removal of minority charge carriers, that a small, laterally directed field is present across the entire width of the channel, such that holes drift towards the zones 316. In the present example with a channel thickness of 1 μm, a value of 15 μm was chosen for the interspacings between the zones 316, which was found to be a favorable value which satisfies both conditions set out above.

The transistor is provided with a drift region 318 between the channel 313 and the drain 310 with a length of, for example, 70 μm in view of the high voltages that may be applied to the drain. The semiconductor layer 303 is provided with a thinned portion at the area of the drift region, in this example formed in that the layer 305 is oxidized through a greater portion of its thickness than at the area of the channel 313. The oxide layer 319 above the drift region 318 has a thickness of approximately 2.0 μm and is accordingly substantially thicker than the silicon oxide layer 315 which forms the gate dielectric of the transistor and which has a thickness of approximately 0.8 μm. A further silicon oxide layer 320, for example in the form of a deposited TEOS layer, is provided on the gate electrode 314 and the oxide layer 319, on which layer 320 a metal field plate 321 is provided. The function of such a field plate, which provides a higher breakdown voltage in combination with a low on-resistance through an improvement in the field distribution, is known. The field plate is connected to the gate 314 and to the p-type zones 316 through contact windows in the oxide layer 320. The gate voltage is accordingly applied to the field plate 320 and the p-type zones 316. Obviously, the zones 316 and/or the field plate may also be connected to other junction points in the circuit, such that other voltages are applied to these regions. The source and drain contacts 311 and 312 are also provided in the oxide layer 320 via contact windows. The field plate 321 may be formed at the same time as the metal contacts 311 and 312.

The thickness of the silicon oxide layer 320 is approximately 0.5 μm. The total thickness of the layers 319 and 320 is accordingly approximately 2.5 μm and is thus equal or at least substantially equal to the thickness of the buried oxide layer 306. Since equal or substantially equal voltages are applied to the gate electrode and the substrate 307 during operation, an electrically substantially symmetrical situation is obtained by means of the equal oxide thicknesses, which is favorable for the electric field distribution and thus for the breakdown voltage of the transistor. A further improvement may be obtained in that the drift region 318 is provided with a profiled doping whose concentration increases linearly in the direction from the source to the drain.

So, the JFET transistor preferably used in the present invention is a deep depletion MOS transistor provided in a thin silicon layer 305 adjoining a surface 304 of a silicon body 303 and isolated from a silicon substrate 307 by a buried oxide layer 306. The channel region 313 of a first conductivity type is provided with at least one and preferably a plurality of surface adjoining zones 316 of the opposite conductivity type to remove minority carriers from the interface between the channel and the gate oxide 315. The zones 316 extend across the whole thickness of the channel region 313 and adjoin the buried oxide layer 306 at the side of the channel region 313 remote from the gate dielectric. Due to this construction, minority carriers are removed also from the rear side of the channel region 313. This enables the transistor to be operative also at high voltages having values at which the substrate 307 and the buried oxide layer 306 are operative respectively as a second gate an a second gate dielectric.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means can be embodied by one and the same item of hardware. The mere fact that certain measures are recited in mutually different dependent claims does not indicate that a combination of these measures cannot be used to advantage.

What is claimed is:

1. A voltage supply circuit, comprising:

a first JFET transistor providing for a majority of an input-to-output voltage drop across its drain-source which is in series connection with a power supply input; and a second JFET transistor providing for a minority of said input-to-output voltage drop, and having its drain-source connected in series with the drain-source of the first JFET transistor, and where both are in series with a load output;

wherein, the gate current of the first JFET transistor is connected to flow through said load output and not directly to ground; and wherein, the gate of the second JFET transistor is connected to ground.

2. A method for improving the efficiency of a voltage supply circuit, comprising:

dropping a majority of an input-to-output voltage drop across the drain-source of a first JFET transistor which is in series connection with a power supply input; and dropping a minority of said input-to-output voltage drop across the drain-source of a second JFET transistor, having its drain-source connected in series with the drain-source of said first JFET, and where both are in series with a load output;

steering the gate current of the first JFET transistor to flow through said load output and not directly to ground; and connecting the gate of the second JFET transistor to ground.

* * * * *